US005956545A

United States Patent [19]

Kim et al.

[11] Patent Number: 5,956,545

[45] Date of Patent: Sep. 21, 1999

[54] IMAGE FORMING DEVICE AND PAPER TRANSPORTING METHOD USED IN THE SAME

[75] Inventors: Kyung-hwan Kim; Min-ho Choi, both of Kyonggi-do, Rep. of Korea

[73] Assignee: SamSung Electronics Co., Ltd., Suwon, Rep. of Korea

[21] Appl. No.: 09/115,594

[22] Filed: Jul. 15, 1998

[30] Foreign Application Priority Data

Jul. 15, 1997 [KR] Rep. of Korea ..... 97-32744

[51] Int. Cl.[6] ..... G03G 15/00

[52] U.S. Cl. ..... 399/107; 399/125; 399/281; 399/283

[58] Field of Search ..... 399/107, 110, 399/111, 112, 118, 119, 121, 123, 125, 223, 227, 298, 303, 124, 120, 283, 281, 350; 347/138, 152

[56] References Cited

U.S. PATENT DOCUMENTS 5,323,210 6/1994 Inomata ..... 399/125 X
5,497,220 3/1996 Inomata et al. ..... 399/120
5,585,598 12/1996 Kasahara et al. ..... 399/227
5,671,465 9/1997 Kimura et al. ..... 399/119
5,742,319 4/1998 Fukunaga et al. ..... 347/138
5,787,326 7/1998 Ogawa et al. ..... 399/124

FOREIGN PATENT DOCUMENTS 9-044039 2/1997 Japan .

*Primary Examiner*—Arthur T. Grimley
*Assistant Examiner*—Sophia S. Chen
*Attorney, Agent, or Firm*—Robert E. Bushnell, Esq.

[57] ABSTRACT

An image forming device and a paper transporting method are capable of improving a paper transporting path by establishing a transfer drum, a developing unit, an optical unit and a paper feeding unit in four quadrant directions centering around a photosensitive drum unit, Thereby, the optical unit is protected from mechanical shock or vibration. Jamming of paper adhered to the transfer drum is easily rectified, and the overall structure of the device is simplified.

34 Claims, 5 Drawing Sheets

IMAGE FORMING DEVICE AND PAPER TRANSPORTING METHOD USED IN THE SAME

CLAIM OF PRIORITY

This application makes reference to, incorporates the same herein, and claims all benefits accruing under 35 U.S.C. §119 from an application entitled Image Forming Device And Paper Transporting Method Used in The Same earlier filed in the Korean Industrial Property Office on Jul. 15, 1997, and there duly assigned Ser. No. 97-32744 by that Office.

BACKGROUND OF THE INVENTION

1. Technical Field

The present invention relates to an image forming device such as a printer, copier and a facsimile, and to a paper transporting method used in the same. More particularly, the invention relates to an image forming device and a paper transporting method capable of improving a paper transporting path by establishing a transfer drum, a developing unit, an optical unit and a paper feeding unit in four quadrant directions centering around a photosensitive drum unit, thereby reducing the curved angle of the supplied paper and simplifying the inner structure of a shell.

2. Related Art

In general, an image forming device includes the following elements: a paper cassette for holding paper stocked therein; a paper feeding unit for supplying paper to the other components of the device; a transfer drum to reach the paper adheres; in optical unit; a photosensitive drum unit; a developing unit for developing an image formed on the photosensitive drum as a visible image as a result of light radiated from the optical unit; a fixing unit for fixing a color image transferred onto the paper; and the eject unit for ejecting the paper.

Typically, the developing unit includes four developers, one for each color to be selectively developed, mounted and rotated concentrically around a center shaft of the turrets of the developing unit. Furthermore, each developer includes a developing roller which contacts the photosensitive drum, a toner supply roller for supplying toner to the developing roller, a blade for controlling the amount of toner adhering to the developing roller, and agitator for supplying toner to the toner supply roller, and a separating wall formed in the developed unit.

There are several problems with image forming devices of the prior art, and they are as follows: (1) it is inconvenient in such devices to exchange or replace components which are out; (2) since the replacement of developers within the developing unit must be performed when they are in a specific position, a manual rotation switch unit must be provided separate from the driving system of the developing unit in order to move the developers to a position for replacement; and (3) when paper adhering to the transfer drum is jammed during operation, the paper must be grassed and taken out of a very narrow space after operating a release unit, but miniaturization of the device causes the narrow space to be extremely small, and thus it is very difficult to grass the paper through the narrow space, and clearance of the jam is therefore very difficult.

SUMMARY OF THE INVENTION

Therefore, it is an object of the present invention to protect an optical unit from mechanical shock or vibration.

It is another object of the present invention to prevent a photosensitive drum from being damaged when exchanging the same.

It is another object of the present invention to easily exchange developers without using a separate device.

It is another object of the present invention to easily process jam of paper adhered to a transfer drum.

It is another object of the present invention to reduce a paper jam by simplifying a paper transporting path.

It is another object of the present invention to simplify the overall structure.

According to one aspect of the present invention, a cover which can be opened and closed is connected to the upper part of a shell. A transfer drum, a developing unit, an optical unit and a paper feeding unit are located in the first to fourth quadrant directions centering on a photosensitive drum unit. In addition, at the upper side of the transfer drum, a fixing unit and an eject unit are located.

Both lateral sides of the cover extend lower than each of rotary shafts of the transfer drum, photosensitive drum unit, and the developing unit.

In addition, a cleaning blade is located at the lower part of the photosensitive drum unit, and removes waste toner remaining after being transferred onto the transfer drum from the photosensitive drum. Preferably, at the lower side of the photosensitive drum, a waste toner box is located to collect the waste toner removed by the cleaning blade. An inlet is formed in the longitudinal direction of the waste toner box so that the waste toner can accurately flow into the inlet. The waste toner box is located so that its inlet can overlap with the cleaning blade.

According to another aspect of the present invention, paper discharged from a paper cassette passes through the paper feeding unit and adheres to the transfer drum along a transporting path, enabling the surface of the paper stacked in the paper cassette to face the surface of the transfer drum, thereby being transported to the photosensitive drum.

Preferably, the discharged paper is adhered to the transfer drum being curved by 90 degrees to the plane of the paper stacked in the paper cassette.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

The objects, characteristics and advantages of the above-described invention will be more clearly understood through the preferable embodiments referring to the attached drawings.

Figure 1:
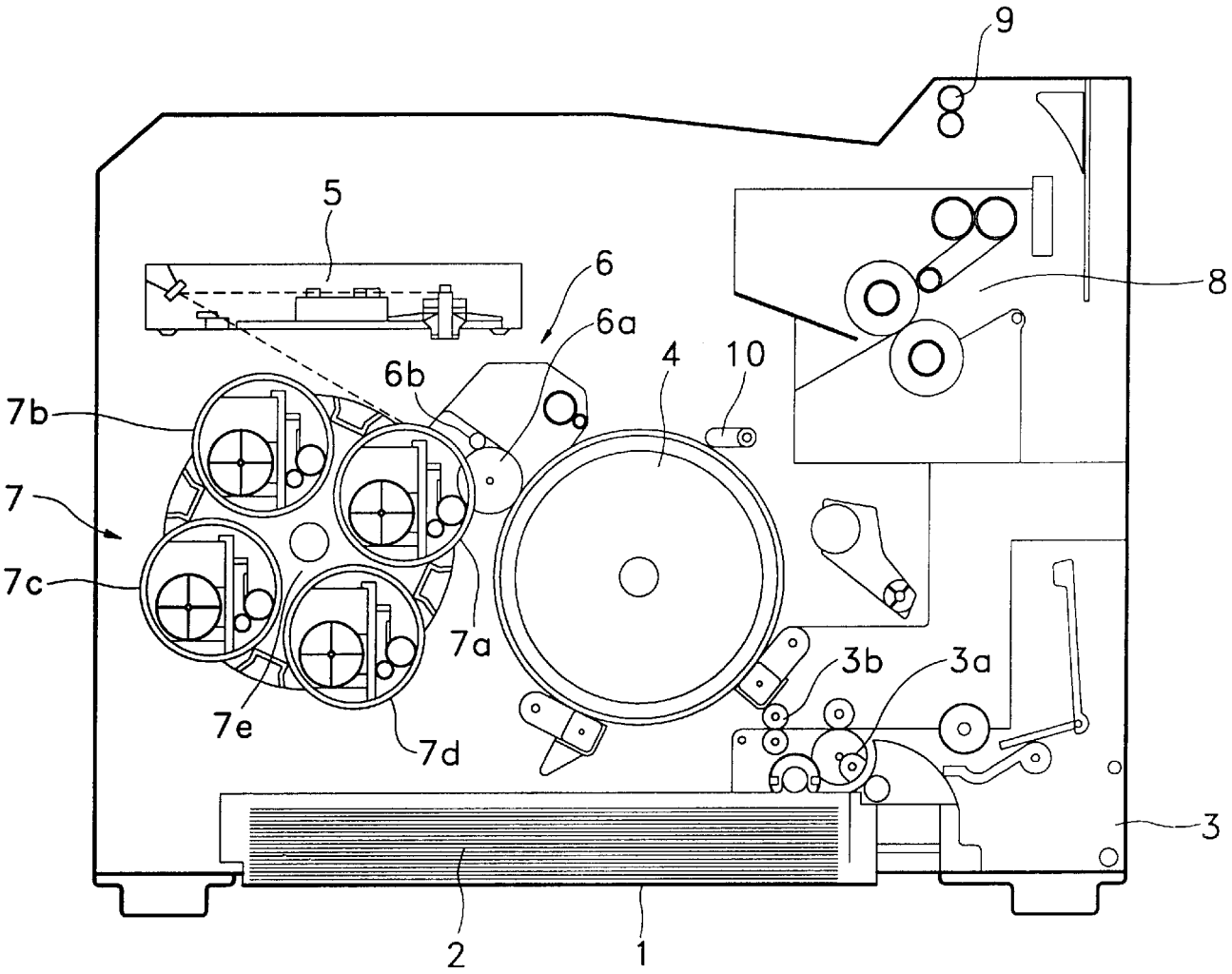
FIG. 1 is a longitudinal section view illustrating an image forming device.

An image forming device is illustrated in FIG. 1. The structure and operation of the image forming device are explained.

The image forming device includes: a paper cassette 1 in which paper 2 which is a recordable medium is stacked; a paper feeding unit 3 for supplying the paper 2; a transfer drum 4 to which the paper 2 is adhered; an optical unit 5; a photosensitive drum unit 6; a developing unit 7 including developers 7*a*–7*d* for developing a latent image formed at the photosensitive drum unit 6 into a visible image by light radiated from the optical unit 5; a fixing unit 8 for fixing a color image transferred onto the paper 2; and an eject unit 9 for ejecting the paper 2.

In the developing unit 7, four developers 7*a* to 7*d* are mounted and rotated concentrically around the center shaft of a turret 7*e* so as to selectively develop toner images of four colors.

Figure 2:
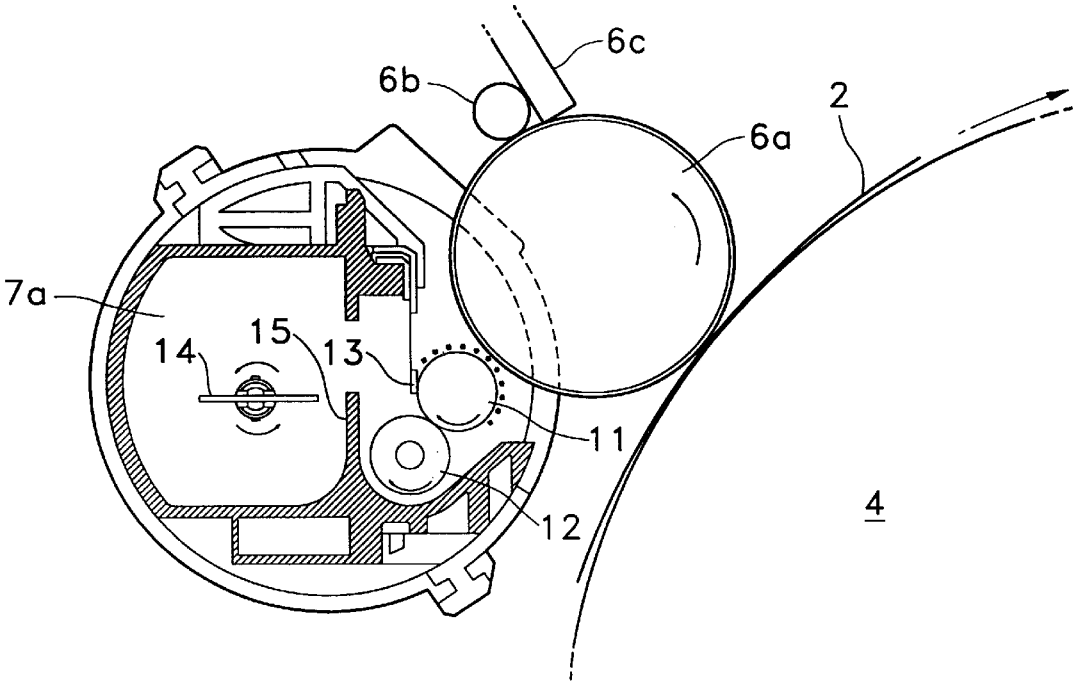
FIG. 2 is an enlarged view illustrating the structure of a developer in FIG. 1.
Figure 3:
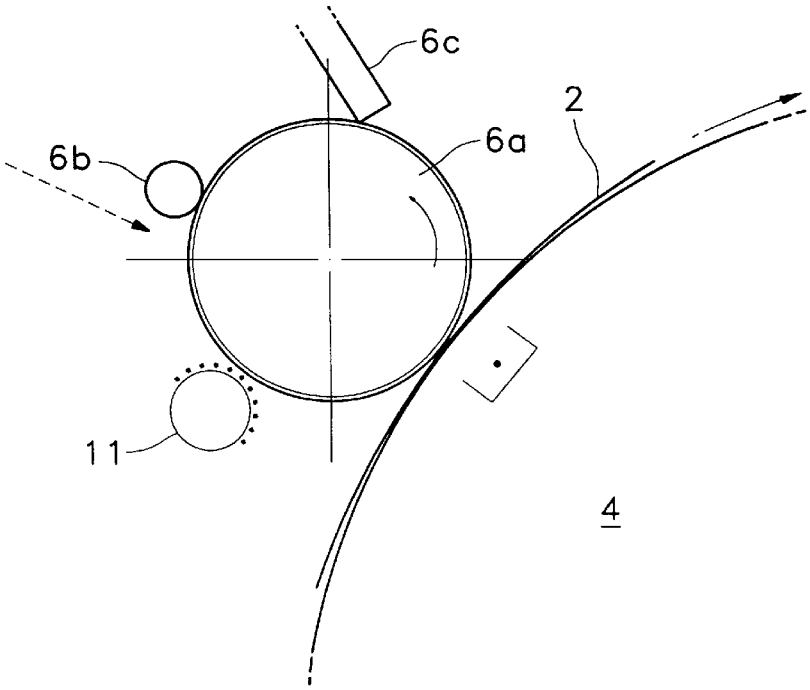
FIG. 3 is a skeleton view for illustrating charging, exposing, developing, transferring and cleaning operations of the device of FIGS. 1 and 2.

In addition, as shown in FIG. 2, each of the developers 7*a* to 7*d* includes: a developing roller 11 in contact with the photosensitive drum 6*a*; a toner supply roller 12 for supplying toner to the developing roller 11; a blade 13 which controls the amount of toner adhered to the developing roller 11; an agitator 14 which supplies the toner to the toner supply roller 12; and a separating wall 15 formed in the developing unit.

The operation of an image forming device having the above structure is explained.

When the photosensitive drum 6*a* rotates, a charging roller 6*b* contacts the surface of the photosensitive drum 6*a* and charges the surface of the photosensitive drum 6*a* by means of a supplied voltage. At this time, the photosensitive drum 6*a* rotates counterclockwise, as illustrated by arrows in FIG. 2, and the charged surface is exposed by the optical unit 5. That is, a laser beam transmitted from the optical unit 5 is modulated into a certain data format, and it selectively exposes the surface of the charged photosensitive drum 6*a*, thereby forming an electrostatic latent image.

When the exposed photosensitive drum 6*a* continuously rotates, the developing roller 11 of one of the developers 7*a* of the developing unit 7 approaches the drum 6*a*. The toner received in the developer 7*a* is supplied across the separating wall 15 to the toner supply roller 12 by the agitator 14, and is then charged by the frictional operation of the toner supply roller 12 and developing roller 11. The charged toner is adhered forming a thick layer on the surface of the developing roller 11. The thickness of the toner adhered to the surface of the developing roller 11 is properly controlled by the blade 13 when the developing roller 11 rotates in the clockwise direction.

Subsequently, when the photosensitive drum 6*a* and the developing roller 11 contact each other, the toner which is charged negatively by an electric potential formed by a bias voltage applied to the developing roller 11 moves to the surface of the photosensitive drum 6*a* from the surface of the developing roller 11 and forms an electrostatic latent image, thereby forming a visible image.

The paper 2 received in the paper cassette 1 is fed by a feeding roller 3*a* of the paper feeding unit 3, and the leading edge of the paper 2 is aligned by a registration roller 3*b*. When the transfer drum 4 rotates clockwise, the registration roller 3*b* approaches the paper 2, and the paper 2 adheres to the transfer drum 4 and is rotated. In this manner, the paper 2 is moved toward the photosensitive drum 6*a*. Since the visible image by the toner is already formed on the photosensitive drum 6*a*, the toner on the photosensitive drum 6*a* is transferred onto the paper 2 by the supplied voltage inside the transfer drum 4.

In order to develop toner of another color, the toner on the photosensitive drum 6*a* is cleaned with a cleaning blade 6*c*. Then, the charging and exposing operations are performed. When the next developer 7*b* is approaches the photosensitive drum 6*a* by rotating the developing unit 7 by 90 degrees, the transfer drum 4 to which the paper 2 is adhered is rotated and the paper 2 approaches the developing roller 11 of the next developer 7*b*. Thereby, the toner of the second color is developed on the paper 2 on which the toner of first color was previously developed.

As described, the above process is repeatedly performed four times in order to realize full color images of four colors.

The paper 2 on which the full color images are formed is rotated as it adheres to the transfer drum 4, and is separated from the surface of the transfer drum 4 by the operation of a separator 10, thereby being transported to the fixing unit 8. After the toner is fixed to the paper 2, the paper is ejected through the eject unit 9 and then stacked in a stacker (not shown).

However, the above image forming device has several problems as follows.

First, it is inconvenient to exchange the articles of consumption. That is, since the photosensitive drum 6*a* is exchanged generally through the lateral side of the image forming device, it is necessary to move the photosensitive drum 6*a* in the axial direction. At that point, the surface of the photosensitive drum 6*a* can be damaged due to contact with the edge of the lateral side. In addition, in order to release the part connected to the transfer drum, there is the inconvenience of additionally using a releasing unit.

Second, since the exchange of the developers 7*a* to 7*d* is performed at a specific position, a manual rotation switch unit established separately from a driving system is required in order to move the developing units to the exchange position.

Third, when the paper adhered to the transfer drum is jammed in operation, the leading edge or end of the paper is grasped and taken out after forming a narrow space by operating the releasing unit using a manual lever for jam processing. In such a case, if this narrow space is very small due to miniaturization of the device, jam processing becomes difficult. In particular, when the leading edge or end of the paper is located at a position which is difficult to grasp through the narrow space, an additional device is required.

Figure 4:
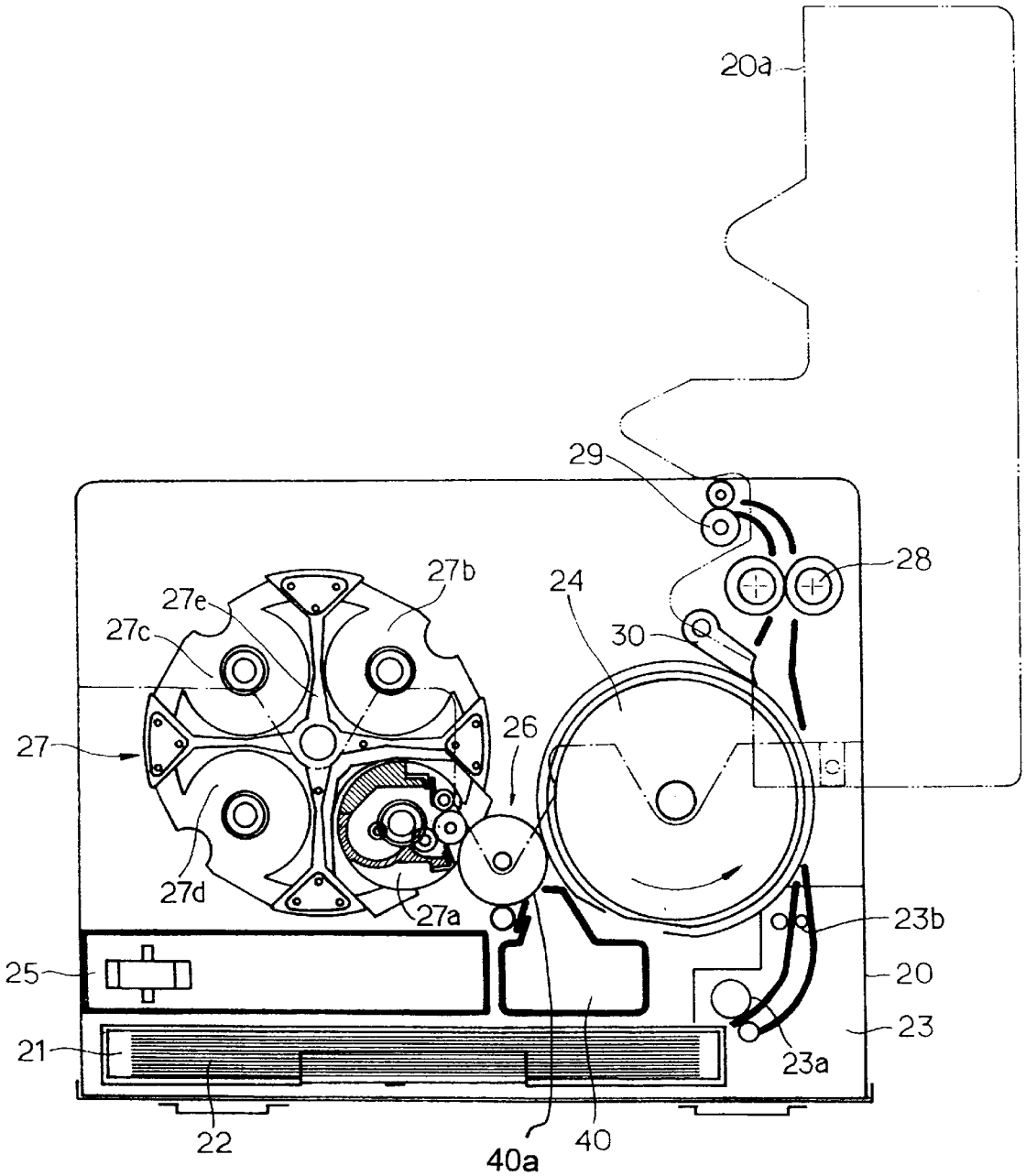
FIG. 4 is a longitudinal section view illustrating the structure of an image forming device according to the present invention.

As described in FIG. 4, according to an image forming device of the present invention, a cover 20*a* is hinge-connected to a shell 20 and is opened/closed at the upper part of the shell 20. The edge of the cover 20*a* contacted to the shell 20 extends downwardly so that each of the rotary shafts of a transfer drum 24, a photosensitive drum unit 26 and a developing unit 27 can be exposed externally. Accordingly, developers of the developing unit 27 or the transfer drum 24 are easily exchanged when the cover 20*a* is opened.

At the inner part of the shell 20, the transfer drum 24 is located at a first quadrant; the developing unit 27 is located in a second quadrant, an optical unit 25 is located in a third quadrant, and a paper feeding unit 23 is located in a fourth quadrant, the quadrants being centered on the photosensitive drum unit 26. At the bottommost edge of the shell 20, a paper cassette 21 on which a plurality of papers 22 is stacked is established.

The optical unit 25 is firmly fixed at the lower side of the developing unit 27, thereby preventing the mechanical shock and vibration form affecting operation.

The paper feeding unit 23 includes a paper feeding roller 23*a* and a registration roller 23*b*. In addition, the photosensitive drum unit 26 includes a photosensitive drum 26*a* which rotates clockwise, a charger 26*b*, and a cleaning blade 26*c*.

Figure 7:
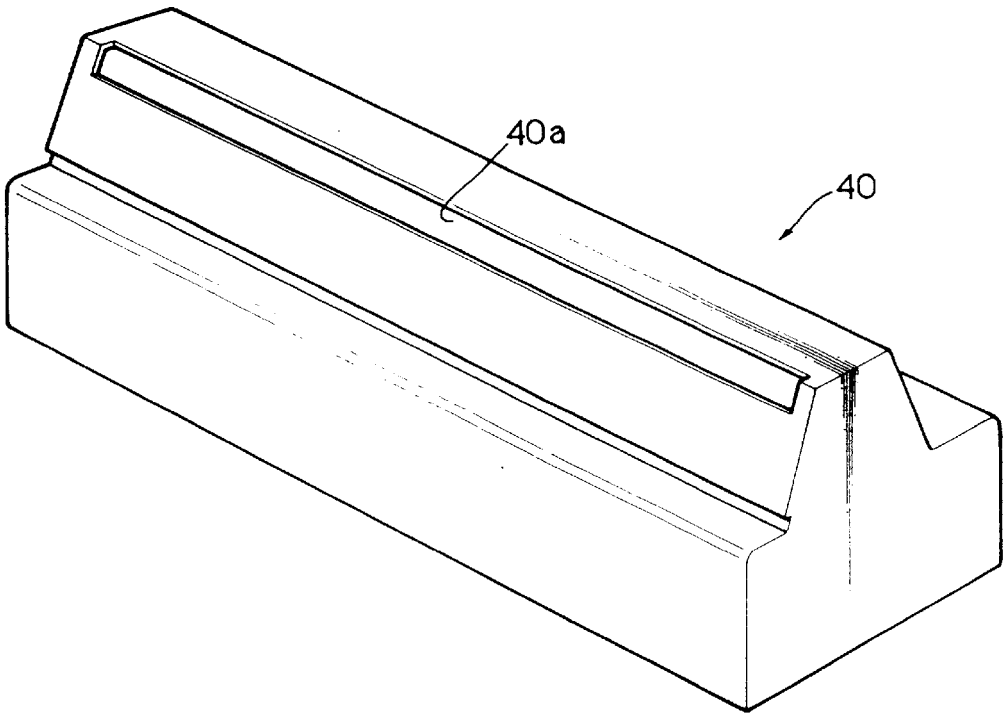
FIG. 7 is a perspective view of a waste toner box applied to the present invention.

The cleaning blade 26*c* is located at the lower side of the photosensitive drum 26*c*, and removes toner remaining after being transferred onto the transfer drum 24 from the photosensitive drum 26*a*. At the lower side of the photosensitive drum 26*a*, a waste toner box 40 is disposed in the longitudinal direction. As illustrated in FIGS. 4 and 7, an inlet 40*a* of waste toner box 40 is established so as to be overlap with the cleaning blade 26*c* so that waste toner collected from the photosensitive drum 26*a* by the cleaning blade 26*c* can accurately flow into the inlet 40*a*.

In addition, the developing unit 27 includes a turret 27*e* and four developers 27*a* to 27*d* for toners of four colors. Each of the developers 27*a* to 27*d* includes a developing roller 31, a toner supply roller 32, and a blade 33 for controlling the toner amount. Here, the blade 33 is established at the lower side of the developing roller 31 so as to contact the outer periphery of the developing roller 31. In a toner container divided by a separating wall 35 of the developers 27*a* to 27*d*, an agitator 34 is located. At the upper side of the developing roller 31, a toner collection roller 36 is located.

At the upper side of the transfer drum 24, a fixing unit 28 and an eject unit 29 for ejecting the paper are established.

Due to the structural characteristic of the present invention, when the cover 20*a* is opened, the transfer drum 24, photosensitive drum unit 26 and the developing unit 27 are exposed externally. As a result, it is easy to replace the developers 27*a* to 27*d* or transfer drum 24. In the case of replacing the photosensitive drum 26*a* and waste toner box 40, they are replaced after the transfer drum 24 and developing unit 27 are taken out.

In addition, even if a paper jam occurs when the paper 22 adheres to the transfer drum 24, the paper 22 can be easily removed once the cover 20*a* is opened because the transfer drum 24 is exposed externally in the longitudinal direction.

In prior arrangements, the structure is complicated. That is, the cleaning blade 6*c* is established at the upper side of the photosensitive drum 6*a*, and the waste toner box is established at the lateral side of the photosensitive drum 6*a*. Thus, waste toner is transported through a separate screw.

However, in the present invention, by locating the waste toner box 40 at the lower side of the photosensitive drum 26*a*, the toner which is cleaned can be collected soon. In addition, since the paper feeding unit 23, fixing unit 28 and eject unit 29 are established at spaces on the upper and lower sides of the transfer drum 24, the size of the shell 20 becomes smaller.

The transporting path of the paper 22 according to the present invention is now explained.

Figure 5:
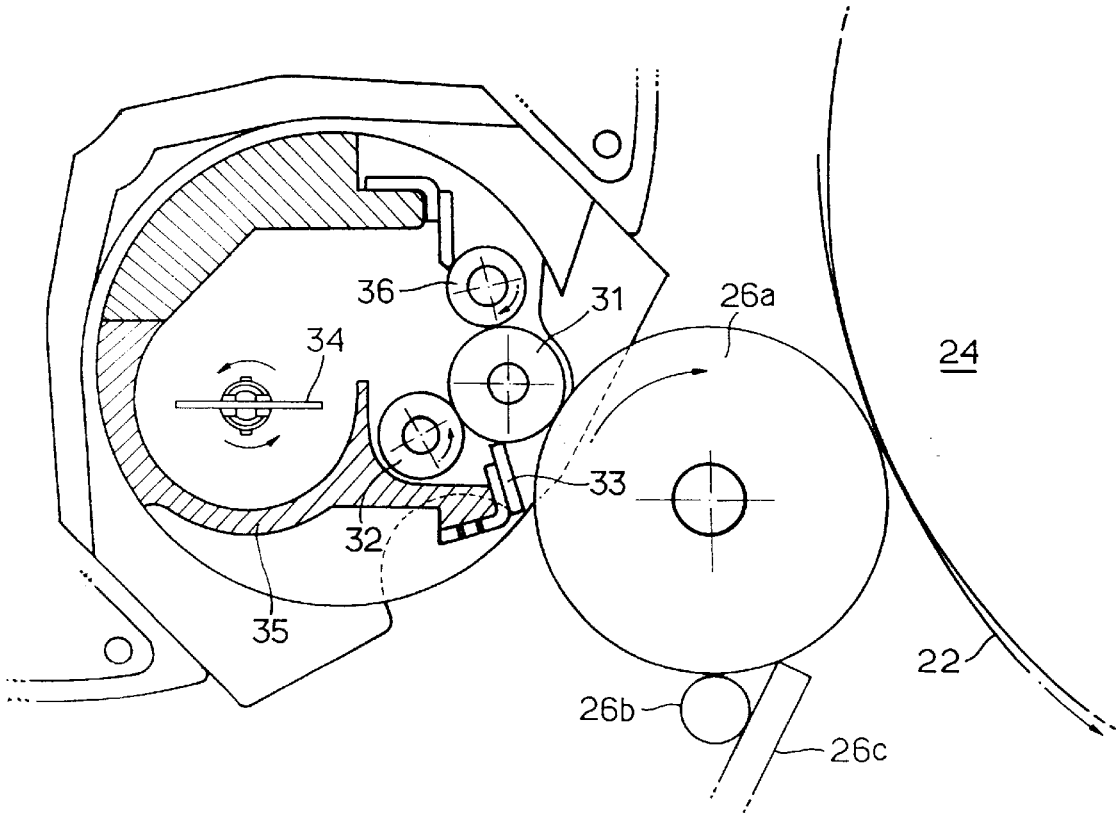
FIG. 5 is an enlarged view illustrating the structure of a developer in FIG. 4.

As shown in FIGS. 4 and 5, the paper 22 received in the paper cassette 21 is discharged from the paper cassette 21 by the feed roller 23*a*, and the leading edge of the paper 22 is aligned so that the paper 22 can be supplied to the upper side by the registration roller 23*b*.

The paper 22, which passes through the registration roller 23*b*, moves up vertically and passes by the photosensitive drum 26*a* while adhering to the outer periphery of the transfer drum 24 as it rotates counterclockwise. At this time, the toner is transferred onto the paper 22, adhered to the transfer drum 24, from the photosensitive drum 26*a*.

Subsequently, the developing unit 27 rotates by 90 degrees. Toner having another color is transferred onto the paper 22 after the paper 22 is rotated once by the transfer drum 24.

Figure 6:
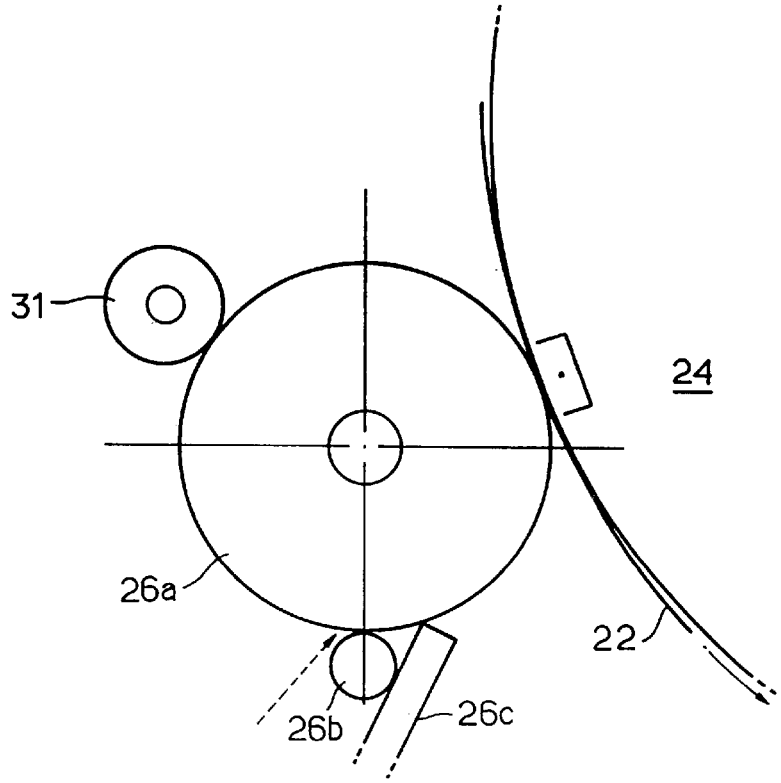
FIG. 6 is a skeleton view illustrating charging, exposing, developing, transferring and cleaning operations according to the present invention.

The exposing, charging and developing operations of the photosensitive drum 26*a* are now explained with reference to FIG. 6.

The photosensitive drum 26*a* is exposed by light radiated from the optical unit 25, and is charged by the neighboring charger 26*b*.

In the developer 27*a*, 27*b*, 27*c* or 27*d* which is selected, when the agitator 34 rotates and the toner is supplied across the separating wall 25, the toner supply roller 32 supplies toner toward the developing roller 31.

When the developing roller 31 is closed to the photosensitive drum 26*a*, the toner is developed onto the photosensitive drum 26*a* and an electrostatic latent image is formed on the surface of drum 26*a* by the optical unit 25, thereby forming a visible image.

Once the toner developed on the surface of the photosensitive drum 26*a* is transferred onto the paper 22 by the transfer drum 24, the image forming operation is completed. The waste toner is collected in the waste toner box 40 located at the lower side of the cleaning blade 26*c*.

The above exposing, charging, developing, transferring and cleaning operations are repeatedly performed four times, and thereby images of four colors are developed on the paper 22.

Subsequently, the paper 22 is separated from the transfer drum 24 by a separator 30, and is transported to the fixing unit 28 so that the developed toner is fixed on the paper 22.

The paper 22 which passes through the fixing unit 28 is ejected onto the stacker formed on the upper surface of the cover 20*a* by the eject unit 29.

According to the present invention, paper 22 is discharged from the paper cassette 21 and adhered to the transfer drum 24 along a transporting path which is formed in the upward direction. Subsequently, the paper 22 is transported in the downward direction and approaches the photosensitive drum 26*a*. As a result, the paper 22 largely rotates along the outer periphery of the transfer drum 24, and it is discharged as it approaches the photosensitive drum 26*a*.

Since the rotation radius of the paper 22 increases, the transportation of paper 22 is easily performed, thereby preventing the paper jam.

In the preferred embodiment, in order to increase the rotation radius, the discharged paper 22 adheres to the transfer drum 24, being curved by 90 degrees to the plane of the paper 22 stacked in the paper cassette 21. Accordingly, the surface of the paper 22 stacked in the paper cassette 21 contacts the surface of the transfer drum 24.

The angle can vary according to the positional relationship between the paper cassette 21 and transfer drum 24. It can be properly selected, considering the entire size of the shell 20, the angle which is curved, and the rotation radius of the document.

In addition, jam processing becomes easy, and the occurrence of a paper jam can be reduced, even in the case of using a thick paper, since the rotation radius of the document is large.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiment disclosed as the best mode contemplated for carrying out the present invention, but that the present invention includes all embodiments falling within the scope of the appended claims.

What is claimed is:

1. An image forming device comprising:

a shell having an upper part;

a cover attached to said upper part of said shell and adapted to be opened and closed;

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering said paper supplied from said paper feeding means;

developing means disposed in a third quadrant for supplying toner to said photosensitive drum unit;

optical means disposed in a fourth quadrant for forming the electrostatic latent image on said photosensitive drum unit;

fixing means disposed at an upper side of said transfer drum means for fixing the toner on said paper in finishing transfer thereof; and ejecting means for ejecting said paper once the toner is fixed;

wherein said cover has lateral sides, and said transfer drum means has rotary shafts, and said lateral sides of said cover extend lower than rotary shafts of said transfer drum means, said photosensitive drum unit, and said developing means.

2. The image forming device of claim 1, wherein said photosensitive drum unit comprises:

a photosensitive drum having an outer periphery and a lower side;

a charger disposed so as to contact said outer periphery of said photosensitive drum; and a cleaning blade which is located at the lower side of said photosensitive drum removing waste toner remaining after transfer onto said transfer drum means from said photosensitive drum.

3. The image forming device of claim 2, further comprising a waste toner box disposed at the lower side of said photosensitive drum unit for collecting the waste toner removed by said cleaning blade.

4. The image forming device of claim 3, wherein said waste toner box has an inlet formed in a longitudinal direction to overlap said cleaning blade so that said waste toner flows accurately into said waste toner box.

5. An image forming device, comprising:

a shell having an upper part;

a cover attached to said upper part of said shell and adapted to be opened and closed;

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering said paper supplied from said paper feeding means;

developing means disposed in a third quadrant for supplying toner to said photosensitive drum unit;

optical means disposed in a fourth quadrant for forming the electrostatic latent image on said photosensitive drum unit;

fixing means disposed at an upper side of said transfer drum means for fixing the toner on said paper in finishing transfer thereof; and ejecting means for ejecting said paper once the toner is fixed;

wherein said photosensitive drum unit comprises:

a photosensitive drum having an outer periphery and a lower side;

a charger disposed so as to contact said outer periphery of said photosensitive drum; and a cleaning blade which is located at the lower side of said photosensitive drum removing waste toner remaining after transfer onto said transfer drum means from said photosensitive drum.

6. The image forming device of claim 5, further comprising a waste toner box disposed at the lower side of said photosensitive drum, for collecting the waste toner removed by said cleaning blade.

7. The image forming device of claim 6, wherein said waste toner box has an inlet formed in a longitudinal direction to overlap said cleaning blade so that said waste toner flows accurately into said waste toner box.

8. An image forming device, comprising:

a shell having an upper part, a cover attached to said upper part of said shell and adapted to be opened and closed;

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering said paper supplied from said paper feeding means;

developing means disposed in a third quadrant for supplying toner to said photosensitive drum unit;

optical means disposed in a fourth quadrant for forming the electrostatic latent image on said photosensitive drum unit;

fixing mews disposed at an upper side of said transfer drum means for fixing the toner on said paper in finishing transfer thereof; and ejecting means for ejecting said paper once the toner is fixed;

wherein said developing means comprises:

a plurality of developers corresponding to a respective plurality of colors, each of said developers including a developing roller;

a toner supply roller;

a blade for controlling toner amount, said blade being located in contact with a lower outer periphery of each said developing roller;

an agitator located in a toner container divided by a separating wall; and a toner collection roller located in contact with an upper outer periphery of each said developing roller.

9. A paper transporting method for an image forming device, comprising the steps of:

adhering paper stacked in a paper cassette to a surface of a transfer drum through a paper feeding unit, wherein said surface of said transfer drum corresponds to a plane opposite a contact plane between said transfer drum and a photosensitive drum unit, and wherein said paper starts to be supplied at said contact plane; and transporting said paper to said photosensitive drum unit;

wherein said adhering step comprises establishing contact between a surface of said paper and a surface of said transfer drum.

10. The method of claim 9, wherein said adhering step comprises curving said paper by 90 degrees relative to a plane of said paper stacked in said paper cassette.

11. An image forming device, comprising:

a cover adapted to be opened and closed:

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering the paper fed by said paper feeding means;

developing means disposed in a third quadrant for supplying toner to said photosensitive drum unit; and optical means disposed in a fourth quadrant for forming the electrostatic latent image on said photosensitive drum unit;

wherein said cover has lateral sides, said transfer drum means has rotary shafts, and said lateral sides of said cover extend lower than at least two of rotary shafts of said transfer drum means, said photosensitive drum unit, and said developing means.

12. The image forming device of claim 11, further comprising a shell having an upper part, and said cover attached to said upper part of said shell.

13. The image forming device of claim 11, further comprising fixing means disposed an upper side of said transfer drum means for fixing the toner on the paper and finishing transfer.

14. The image forming device of claim 11, wherein said lateral sides of said cover extend lower than said rotary shafts of said transfer drum means and said photosensitive drum unit.

15. The image forming device of claim 11, wherein said lateral sides of said cover extend lower than said photosensitive drum unit and said developing means.

16. The image forming device of claim 11, wherein said lateral sides of said cover extend lower than said developing means and said rotary shafts of said transfer drum means.

17. The image forming device of claim 11, wherein said lateral sides of said cover extend lower than said rotary shafts of said transfer drum means, said photosensitive drum unit and said developing means.

18. An image forming device, comprising:

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering said paper fed by said paper feeding means;

developing means disposed in a third quadrant for supplying toner to said photosensitive drum unit; and optical means disposed in a fourth quadrant for forming the electrostatic latent image on said photosensitive drum unit;

wherein said photosensitive drum unit comprises:

a photosensitive drum having an outer periphery and a lower side;

a charger disposed so as to contact said outer periphery of said photosensitive drum; and a cleaning blade which is located at the lower side of said photosensitive drum for removing waste toner remaining after transfer onto said transfer drum means from said photosensitive drum.

19. The image forming device of claim 18, further comprising a waste tone box disposed at the lower side of said photosensitive drum for collecting the waste toner removed by said cleaning blade.

20. The image forming device of claim 19, wherein said waste toner box has an inlet formed in a longitudinal direction to overlap said cleaning blade so that said waste toner flows accurately into said waste toner box.

21. An image forming device, comprising:

a photosensitive drum unit on which toner is developed and an electrostatic latent image is formed;

paper feeding means disposed in a first quadrant among a plurality of quadrants centered around said photosensitive drum unit for feeding a paper in said device;

transfer drum means disposed in a second quadrant for adhering said paper fed by said paper feeding means;

developing means disposed in a third quadrant for supplying toner to said photosensitive drum unit; and optical means disposed in a fourth quadrant for forming the electrostatic latent image on said photosensitive drum unit;

wherein said developing means comprises:

a plurality of developers corresponding to a respective plurality of colors, each of said developers including a developing roller;

a toner supply roller;

a blade for controlling toner amount, said blade being located in contact with a lower outer periphery of each said developing roller;

an agitator located in a toner container divided by a separating wall; and a toner collection roller located in contact with an upper outer periphery of each said developing roller.

22. A paper transfer method for an image forming device having a transfer drum, comprising the steps of:

stacking paper in a paper cassette;

feeding said paper to a transfer zone in said image forming device;

adhering said paper to a surface of said transfer drum by establishing contact between a predetermined surface of said paper and an external surface of said transfer drum, wherein said surface of said transfer drum corresponds to a plane opposite a contact plane between said transfer drum and a photosensitive drum unit, and wherein said paper starts to be supplied at said contact plane; and transporting said paper to a said photosensitive drum unit.

23. The method of claim 22, wherein said adhering step comprises curving said paper by 90 degrees relative to a plane of said paper stacked in said paper cassette.

24. An image forming device, comprising:

a shell having an upper part;

a cover attached to said upper part of said shell and adapted to be opened and closed;

a photosensitive drum unit on which toner is developed and an electrostatic latent image is formed;

a paper feeding unit disposed in a fourth quadrant among a plurality of quadrants centered around said photosensitive drum unit for feeding a paper in said device;

a transfer drum unit disposed in a first quadrant for adhering said paper supplied from said paper feeding unit;

developing unit disposed in a second quadrant for supplying toner to said photosensitive drum unit;

an optical unit disposed in a third quadrant for forming the electrostatic latent image on said photosensitive drum unit, wherein said optical unit is disposed at lower portion of said developing unit in said shell;

a fixing unit disposed at an upper side of said transfer drum unit for fixing the toner on said paper in finishing transfer thereof; and an ejecting unit for ejecting said paper once the toner is fixed.

25. The image forming device of claim 24, wherein said cover has lateral sides, and said transfer drum unit has rotary shafts, and said lateral sides of said cover extend lower than said rotary shafts of said transfer drum unit, said photosensitive drum means, and said developing unit.

26. The image forming device of claim 24, wherein said developing unit comprises:

a plurality of developers corresponding to a respective plurality of colors, each of said developers including a developing roller;

a toner supply roller;

a blade for controlling toner amount, said blade being located in contact with a lower outer periphery of each said developing roller;

an agitator located in a toner container divided by a separating wall; and a toner collection roller located in contact with an upper outer periphery of each said developing roller.

27. An image forming device comprising:

a shell having an upper part;

a cover attached to said upper part of said shell and adapted to be opened and closed;

a photosensitive drum unit on which toner is developed and an electrostatic latent image is formed;

a paper feeding unit disposed in a fourth quadrant among a plurality of quadrants centered around said photosensitive drum unit for feeding a paper in said device;

a transfer drum unit disposed in a first quadrant for adhering said paper supplied from said paper feeding unit;

a developing unit disposed in a second quadrant for supplying toner to said photosensitive drum unit; and an optical unit disposed in a third quadrant for forming the electrostatic latent image on said photosensitive drum unit, wherein said optical unit is disposed at a lower portion of said developing unit in said shell.

28. The image forming device of claim 27, wherein said cover has lateral sides, and said lateral sides of said cover extend lower than said rotary shafts of said transfer drum unit and said photosensitive drum unit.

29. The image forming device of claim 27, wherein said cover has lateral sides, and said lateral sides of said cover extend lower than said photosensitive drum unit and said developing unit.

30. The image forming device of claim 27, wherein said cover has lateral sides, and said lateral sides of said cover extend lower than said developing unit and said rotary shafts of said transfer drum unit.

31. The image forming device of claim 27, wherein said photosensitive drum unit comprises:

a photosensitive drum having an outer periphery and a lower side;

a charger disposed so as to contact said outer periphery of said photosensitive drum; and a cleaning blade which is located at the lower side of said photosensitive drum for removing waste toner remaining after transfer onto said transfer drum unit from said photosensitive drum.

32. The image forming device of claim 31, further comprising a waste toner box disposed at the lower side of said photosensitive drum for collecting the waste toner removed by said cleaning blade.

33. The image forming device of claim 32, wherein said waste toner box has an inlet formed in a longitudinal direction to overlap said cleaning blade so that said waste toner flows accurately into said waste toner box.

34. The image forming device of claim 27, wherein said developing unit comprises:

a plurality of developers corresponding to a respective plurality of colors, each of said developers including a developing roller;

a toner supply roller;

a blade for controlling toner amount, said blade being located in contact with a lower outer periphery of each said developing roller;

an agitator located in a toner container divided by a separating wall; and a toner collection roller located in contact with an upper outer periphery of each said developing roller.

* * * * *